United States Patent [19]

Reich

[11] 4,095,414

[45] Jun. 20, 1978

[54] ELECTRONIC TIMEPIECE

[76] Inventor: Joachim Reich, am Holzweg 21, D 8036 Herrsching (Ammersee), Germany

[21] Appl. No.: 678,190

[22] Filed: Apr. 19, 1976

[30] Foreign Application Priority Data

Nov. 17, 1975 Germany ..... 2551542

[51] Int. Cl.[2] ..... G04C 3/00; G04B 19/30; G04B 19/06

[52] U.S. Cl. ..... 58/50 R; 58/23 R; 58/127 R; 235/92 T

[58] Field of Search ..... 58/23 R, 50 R, 127 R; 235/92 PE, 92 T

[56] References Cited

U.S. PATENT DOCUMENTS

| | | | |
|---|---|---|---|
| 3,276,200 | 10/1966 | Freeman | 58/50 |
| 3,422,253 | 1/1969 | Lundin | 235/92 |
| 3,456,162 | 7/1969 | Andersen | 315/84.6 |
| 3,540,209 | 11/1970 | Zatsky et al. | 58/50 R |
| 3,748,580 | 7/1973 | Stevens et al. | 324/178 |
| 3,992,875 | 11/1976 | Kashio | 58/50 R |

*Primary Examiner*—Edith S. Jackmon
*Attorney, Agent, or Firm*—Price, Heneveld, Huizenga & Cooper

[57] ABSTRACT

The specification describes an electronic timepiece with a display device, with an oscillator as a time base, with a frequency divider, which steps down the frequency of the oscillator to the desired clock frequency, with counting means for counting the clock pulses and with decoding circuits, which present the clock pulses to the display device in the clock pulse frequency in such a manner that in the rhythm of this clock pulse frequency time marks are inserted. The counting means consist of a forward-backward counter and a following simple counter, which on a complete operational cycle runs completely through the number of time marks completely. The outputs of the decoding device of the simple counter are connected respectively with the one electrode of one respective group of time marks. The outputs of the decoding device of the forward-backward counter are connected with the other electrode of one number of time marks corresponding to the number of outputs, and the following time marks are so connected with these time marks that the time marks following the time mark connected with the last output of the decoding device are respectively connected with the outputs of the decoding device in a reversed sequence and this coupling of the time marks is continued until coverage of the number of time marks has been completed.

14 Claims, 11 Drawing Figures

ELECTRONIC TIMEPIECE

BACKGROUND OF INVENTION (1) Field to Which Invention Relates

The invention relates to an electronic timepiece with a display device, with an oscillator as a time base, with a frequency divider, which steps down the frequency of the oscillator to the desired clock frequency, with counting means for counting the clock pulses and with decoding circuits, which present the clock pulses to the display device in the clock pulse frequency in such a manner that in the rhythm of this clock pulse frequency time marks are switched on.

(2) The Prior Art

Such an electronic timepiece is to be derived generally from the German Pat. (Auslegeschrift) No. 1,548,081 and the German Pat. (Offenlegungsschrift) No. 1,937,868.

SUMMARY OF THE INVENTION

One aim of the present invention is to afford such an electronic timepiece, which is only to be found in the prior art as regards its basic concept and its theoretical structure, with such a development that using circuits in known technologies offered by producers of integrated circuits simple and cheap production becomes possible.

In order to achieve this aim the invention provides that the counting means consist of a forward-backward counter and a following simple counter, which on a complete operational cycle runs through the number of time marks completely;

in that the outputs of the decoding device of the simple counter are connected respectively with the one electrode of one respective group of time marks;

in that the outputs of the decoding device of the forward-backward counter are connected with the other electrode of time marks corresponding in quantity to the quantity of outputs and in that the following time marks are so connected with these time marks that the time marks following the time mark connected with the last output of the decoding device are respectively connected with the outputs of the decoding device in a reversed sequence and this coupling of the time marks is continued until coverage of the number of time marks has been completed.

With such an arrangement the advantage is achieved that all conductor tracks with the exception of the one electrode of the time marks can be printed simultaneously on a suitable insulating carrier. Such a printing operation is easy and cheap to carry out.

It is thus in this respect only a question of a single working operation which produces all conducting tracks.

In accordance with a further development of the invention the clock pulse frequency is a minute frequency in the case of which a second arrangement of counting devices, consisting of a forward-backward counter and a following simple counter is provided which is coupled via a divider with the input of the simple counter of the first counting device, which is placed between the input of the simple counter of the first counting device and the input of the forward-backward counter of the second counting device and the forward-backward counter and the simple counter of the second counting device are provided respectively with a decoding device, which respectively drive a second group of time marks along the same lines as the driving of the first group of time marks.

For the case that the clock pulse frequency is a minute frequency it is possible to achieve with this circuit the advantage that the timepiece not only indicates minutes and full hours but also parts of hours, preferably every quarter of an hour.

Since it is not always possible to ensure that the forward-backward counter provides a signal stepping up the following simple counter in changing the counting direction, it is convenient if in accordance with a further development of the invention the first and last output of the decoding device of the forward-backward counter is connected via a NAND-gate with the following simple counter.

It is thus possible to ensure reliably that the switching-on signal for the following simple counter is produced when the forward-backward counter jumps to an end position.

It is also possible to achieve, as an alternative in accordance with the invention, the same effect if parallel to the forward-backward counter a counter having a number of counting stages reduced by "1," or a divider is connected which is set at "1" when the forward-backward counter is at "1."

If in accordance with a further development of the invention the connections for the one electrode of the time marks and the connecting paths for the connections of these electrodes of the time marks alongside each other are printed on an insulating carrier, it is then not only possible to produce a compact unit but also soldered joints are avoided, which can severally be a source of disturbances.

In the case of such printing onto an insulating carrier it is to be recommended, that in accordance with a further development of the invention, on the insulating carrier in its free central part are printedconnections to be connected with the other electrode of the time marks further connections which can be connected with the integrated circuit comprising the oscillator, the divider stages, the counters, and the decoding means and finally all conducting paths which connect the connections of the time mark electrodes with the connections of the integrated circuit. With this arrangement it is possible to arrange the integrated circuit in a particularly simple manner, for example with the socalled flip-chip technology on the printed connection points for the integrated circuit.

In accordance with a further development of the invention it is advantageous to use LED'S as time marks. In this case in accordance with a further development of the invention for further simplification and cheapening of the arrangement in lieu of individual LED'S a block, extending over a number, reduced by the digit "1" of the outputs of the decoding circuit of the forward-backward counter, of time marks, consisting of LED material can be provided, which is metallized in sections on the surface mounted on the insulating carrier and at these sections is soldered to the connections and on the side remote from this has at those positions, at which the time marks are to appear, a respective grid-like metallization, these metallizations being connected with each other and with the corresponding output of the decoding circuit of the simple counter.

The grid-like metallizations of the time marks and the associated metallizations on the other side of the block are advantageously directed towards the center of the circular arrangement, because in this manner the time marks can be constructed as lines or like the hands of a timepiece.

The grid-like metallizations connected with each other, which form the cathodes of the LED'S, can be connected with the connections of the decoding devices by bonding. Since bonding makes manual operation necessary, it is however more convenient, simpler and cheaper, if in accordance with a further development of the invention an insulating layer is placed over the completely equipped circuit, on which conducting tracks are provided, which via windows in the insulating layer provide a conducting connection between the blocks and the corresponding connections of the integrated circuit.

In order to ensure that the electronic timepiece has a pleasing appearance in accordance with a further embodiment of the invention, the arrangement constructed on the insulating carrier can be covered with a covering plate constructed to resemble the face of a clock and consisting of non-transparent or opaque material and which adjacent to the time marks is made to be at least transluscent. As a result it is possible, taking as a basis the same electronic basic unit, to construct time pieces of very different exterior appearance, which are adapted to taste and fashion as may be required.

In accordance with a modified further development of the invention a suitably dimensioned liquid crystal cell is employed as a dial for the timepiece, whose one surface carries transparent electrodes, corresponding to the arrangement of the time marks the electrodes being so connected that the following time marks are so connected with the preceding time marks that the time marks following the time mark connected with the last output of the decoding device are respectively connected with the other outputs of the decoding device in a reversed sequence and this coupling of the time marks is continued for the whole of the timepiece dial while its surface remote from a viewer is covered at the positions of the time marks with substantially non-transparent electrodes.

In this respect in accordance with a further development of the invention it is convenient for the electrodes serving for excitation of the liquid crystal cell to be passed from two surfaces via rings of rubber which becomes conductive under pressure to the carrier for the integrated circuit.

Finally, in accordance with a further development of the invention a light source can be arranged behind the liquid crystal cell.

LIST OF SEVERAL VIEWS OF DRAWINGS

Embodiments of the invention are now described with reference to the accompanying drawings.

Figure 3:
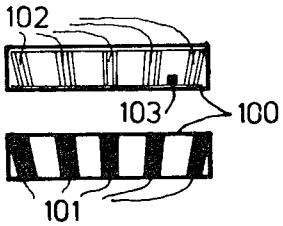

FIG. 3*a* shows the cathode side of an LED arrangement.

FIG. 3*b* shows the anode side of this LED arrangement.

Figure 4:
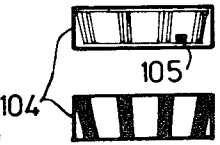

FIG. 4*a* shows the cathode side of an LED arrangement for displaying the hours.

FIG. 4*b* shows the anode side of the LED arrangement in accordance with FIG. 4*a*.

Figure 5:
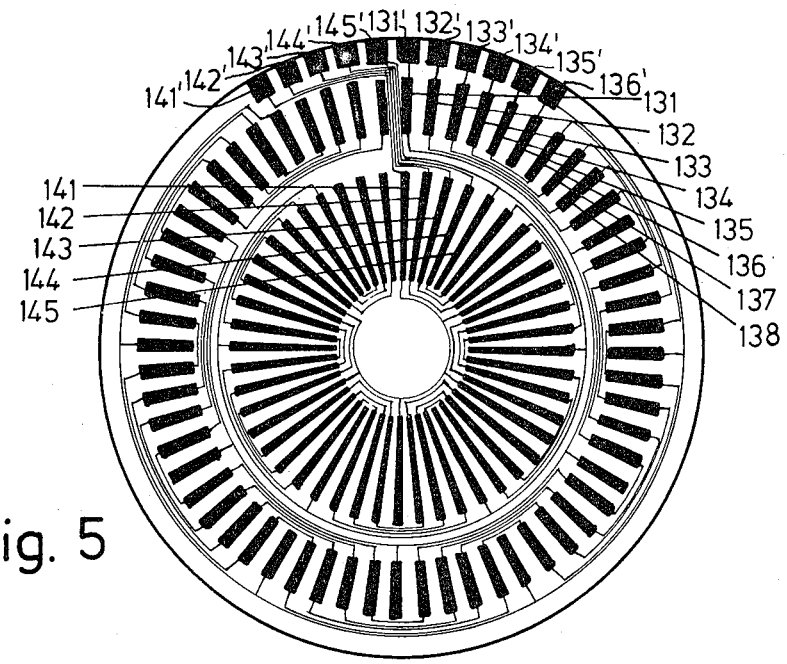

FIG. 5 shows the side adjacent to the observer of a liquid crystal cell forming the timepiece dial.

Figure 6:
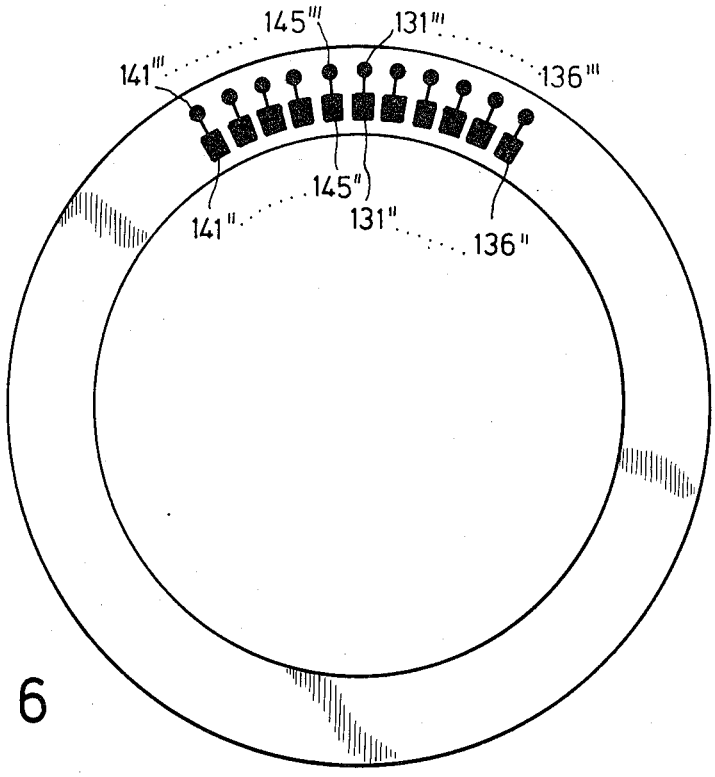

FIG. 6 is a plan view of a ring of insulating material, which comprises the supply connections for the time marks.

Figure 7:
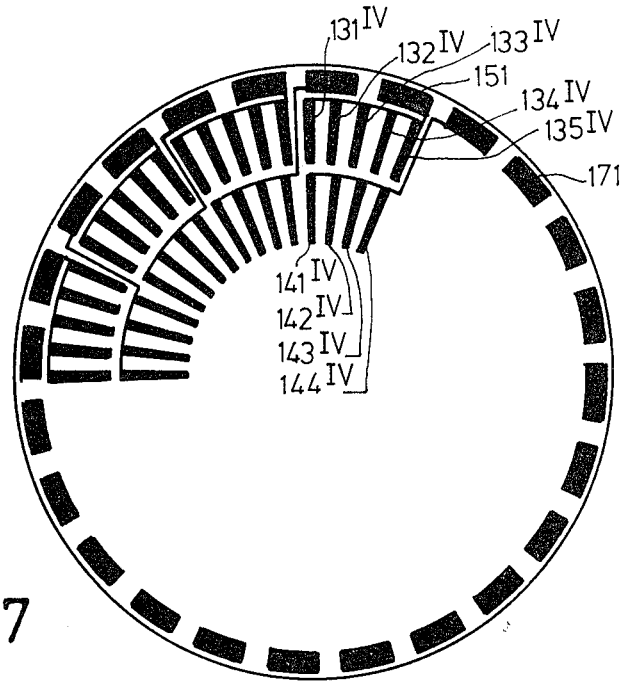

FIG. 7 shows the lower side of the liquid crystal cell.

Figure 8:
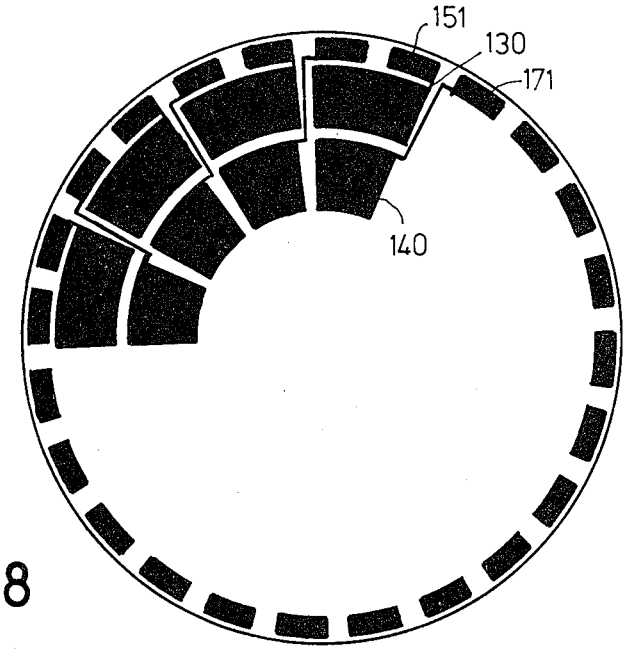

FIG. 8 shows an alternative for the lower side of the liquid crystal cell.

Figure 9:
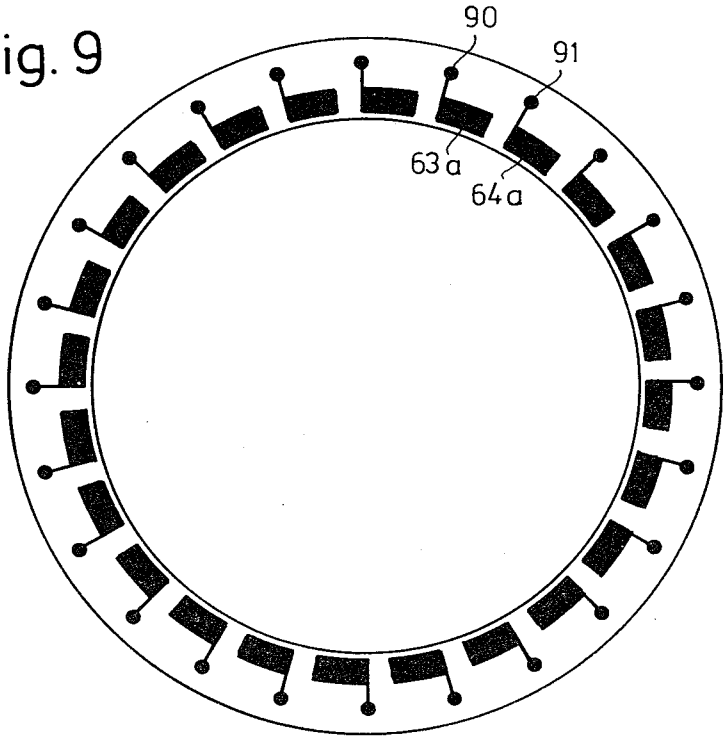

FIG. 9 shows a ring of insulating material, which produces the contacts to the electrodes on the lower side of the liquid crystal cell.

Figure 10:
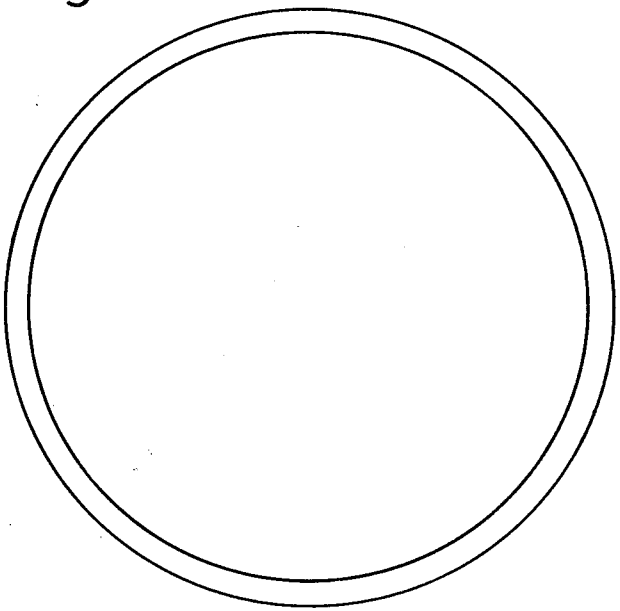

FIG. 10 shows the rings of rubber which becomes conducting under pressure for producing contact between the surface of the liquid crystal cell and the contact surfaces printed on the insulating material.

Figure 11:
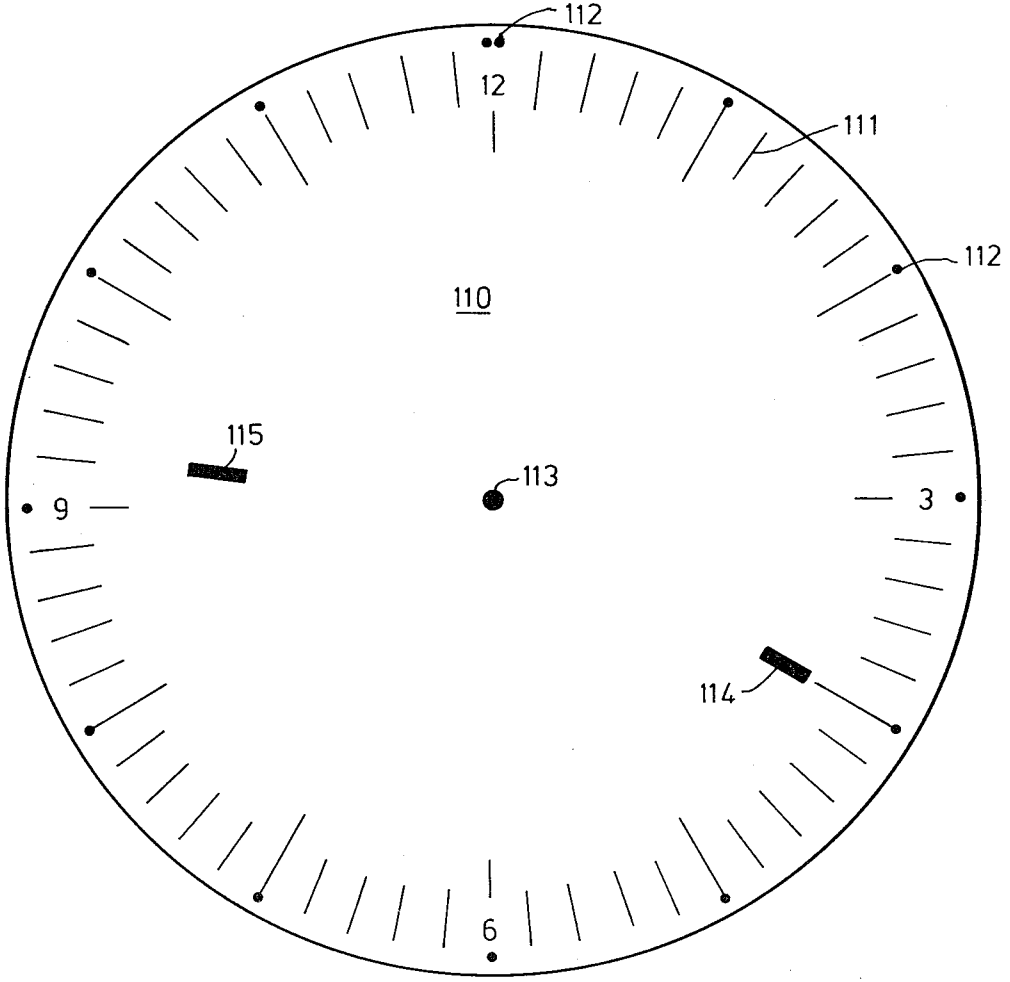

FIG. 11 shows a plan view of a possible timepiece dial arrangement.

DESCRIPTION OF PREFERRED EMBODIMENTS

Figure 1:
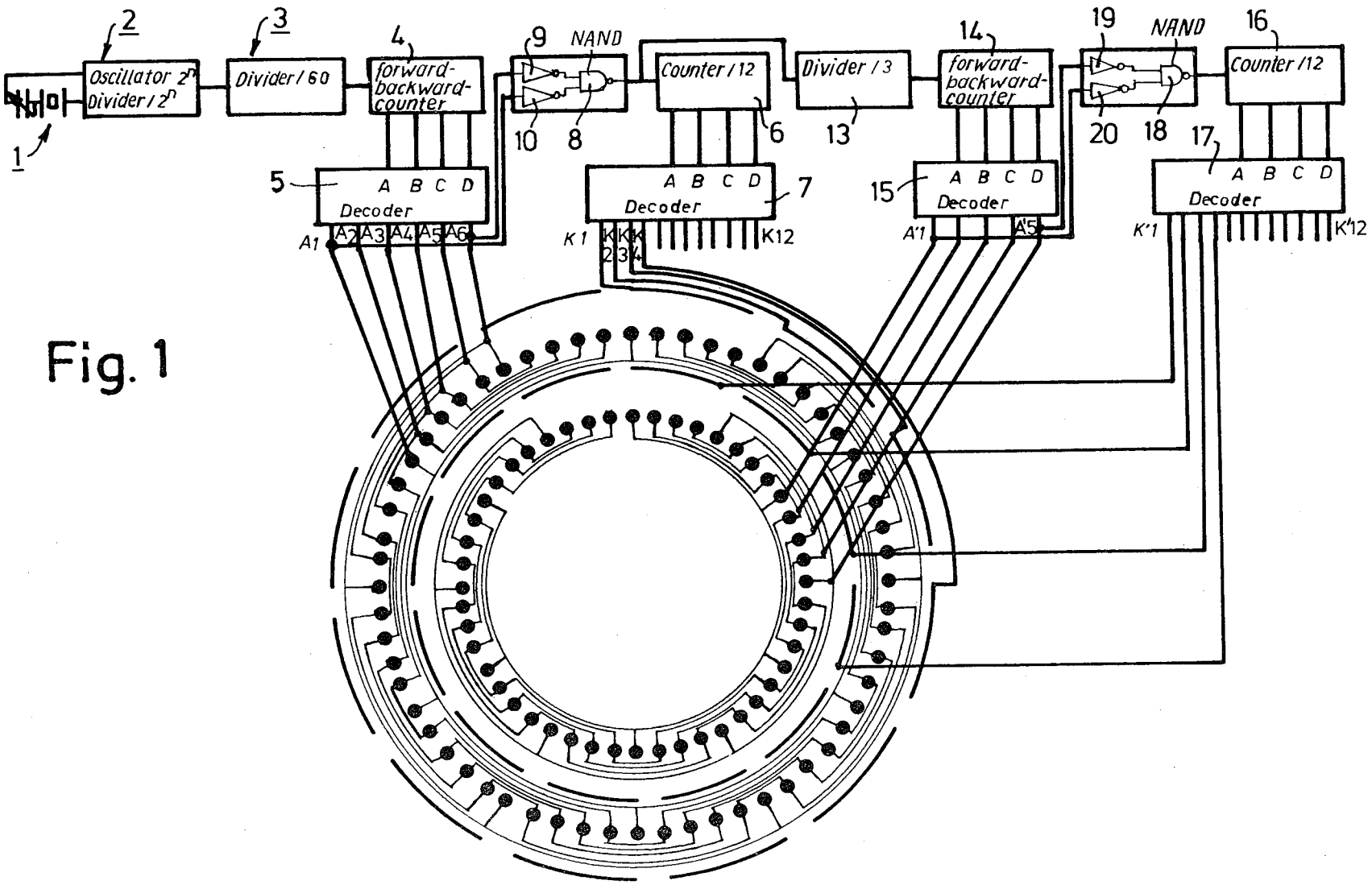
FIG. 1 shows a block circuit diagram of an electronic timepiece in accordance with the invention.

Reference numeral 1 in FIG. 1 denotes an arrangement of a quartz crystal and a regulating capacitor associated with it. This arrangement stabilizes the oscillator shown at 2 at the resonance frequency of the quartz. In the element 2 accommodating the oscillator furthermore a divider is accommodated, which converts the frequency into a pulse frequency of 1/sec. so that at the output of the divider a seconds beat can be indicated or displayed. There then follows a divider 3, which at its output supplies a beat frequency of 1/min., which is counted in the counter 4. This counter is a forward-backward counter and counts from one to six and then back again to one. At its outputs A, B, C, D the inputs A, B, C, D of a decoder are connected, which decodes the conditions of the outputs of the counter and via the outputs $A_1$ to $A_6$ passes on to six subsequently following time marks. In this respect the output $A_1$ is placed at a time mark, which later on putting the timepiece together and placing the timepiece face in position is associated with the number 12. Naturally each time mark directly connected with this time mark can also be associated with the number 12. The outputs $A_2$ to $A_6$ are connected to the time marks following in the clockwise direction, the time mark connected to output $A_1$ the time mark following, in the clockwise direction, the time mark coupled to output $A_6$, is connected with the time mark preceding the time mark connected with the output $A_6$ etc., as can clealy be seen from the drawing.

After five respective steps the forward-backward counter 4 will have reached an end position and then a signal is passed to the following simple counter 6. This signal appearing at the simple counter 6 is decoded by a further decoder 7 and via the connections $K_1$ to $K_{12}$ it is passed on to the other electrode of the time marks, which are respectively connected together to form groups of five time marks. For simplification of the drawing only the outputs $K_1$ to $K_4$ at the decoder 7 are reproduced with their respective connections with the time marks.

In the case of every pulse which comes from the counter 3 the forward-backward counter 4 is advanced by one step so that respectively the following time mark is caused to be displayed. When the count of the forward-backward counter 4 reaches its end position, a signal is fed to the simple counter 6 and the next group of time marks is made ready for switching, since the group electrode is now connected with voltage.

In order to pass the signal in the end positions of the forward-backward counter 4 to the simple counter 6, the decoder 5 is connected with the simple counter 6 via a NAND-gate 8. Since a time mark is only caused to shine when at its electrodes different polarities are present, it is necessary to take steps to see that at the inputs of the NAND-gate on achieving the end count of the forward-backward counter one input of the NAND-gate comprising two inputs is switched over from H to L. If therefore the decoder 5 on switching on of one time mark jumps to H, before the input of the NAND-gate 8 it is necesssary for one respective inverter 9 or 10 to be switched, since the NAND-gate 8 only provides a signal when the two inputs are at H and one input jumps to L.

An alternative arrangement deleting NAND-gate 8 with its inverters 9 and 10 is possible.

In the case of this alternative embodiment parallel to the forward-backward counter 4 a simple counter or divider is connected, which only counts up to 5, when the forward-backward counter is a counter which counts to 6. Since on switching on the timepiece simple counter or divider can stop at some position, a feedback path between this counter and the forward-backward counter 4 is provided, which sets this counter at zero when the forward-backward counter is at 1. This return setting is carried out during the running of the clock naturally only once as otherwise the two counters run in parallel. The simple counter 11 or divider accordingly provides one pulse every five minutes to the input of the simple counter 6. In other respects the manner of operation for the time marks is the same.

From the output of the simple counter 6, at which every five minutes an advancing or switching-on signal appears, a connection leads via a divider 13 to a forward-backward counter 14. The divider 13 ensures that at the forward-backward counter 14, for example every 15 minutes a signal appears so that for the hours display every quarter of an hour a signal appears, because it is only then that the time can be unambiguously read off.

The condition of the counter 14 is decoded by the decoder 15 and its outputs A'1 . . . A'5 are connected with the time marks, which are represented on the inner circle and are in a sequence just as described above on the outer circle of time marks.

Figure 2:
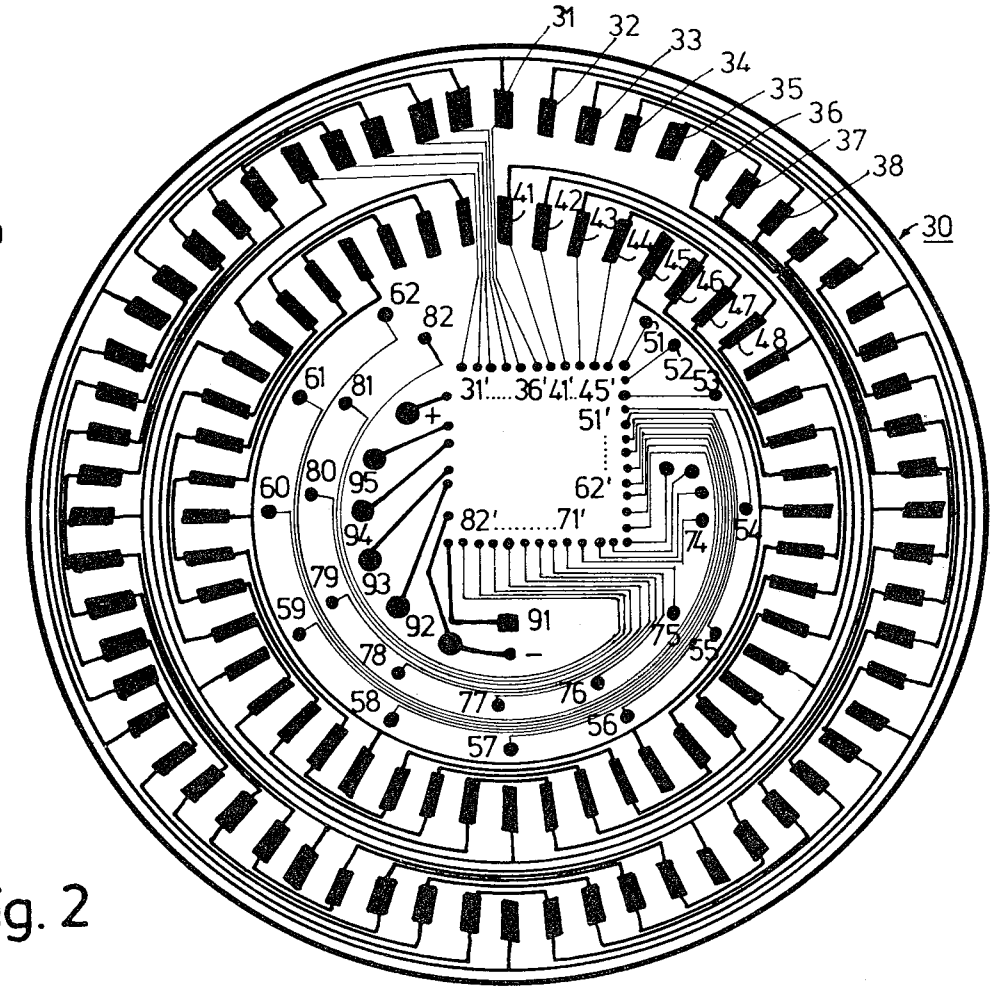
FIG. 2 shows a printing plan in accordance with the invention, in the case of which the parts indicated in FIG. 1 in the block diagram, of the electronic circuit are omitted.

The forward-backward counter 14 passes a signal to the simple counter 16, whose conditions are decoded via the decoder 17. The outputs K'1 . . . K'12 of this decoder 17 are connected with the other electrodes of the inner time marks connected together in groups. The provision of the advancing signal for the simple counter 16 is carried out in the same manner as is the case with the simple counter 6 either via the NAND-member 18 with possibly preceding inverters 19, 20 or via an additional simple counter. FIG. 2 shows the printing plan as to how the time mark connections and their connection parts and the connections for the integrated circuit are printed on a single insulating carrier 30. The connections 31 to 36 for the one electrode of the time marks are connected together with the the following connections 37, 38 . . . and with the connections 31' . . . 36' for the integrated circuit. Correspondingly the connections 41 to 45 are connected together with the following connections 46, 47, 48 . . . and with the connections 41' . . . 45' of the integrated circuit. The connections for the other electrodes are grouped in a circle around the center of the insulating carrier and denoted by reference numerals 51 . . . 62 and, respectively 71 . . . 82. Their corresponding connections with the integrated circuit are denoted by reference numerals 51' . . . 62' and, respectively, 71' . . . 82'.

Furthermore, connections for the + and − poles of the battery are provided which are suitably indicated. The connection 91 is the connection for the seconds pulse frequency. The connection 92 is for the setting of the minutes. The connection 93 is for the setting of the hours and the connections 94 and 95 serve for connection for the quartz and the regulating capacitor.

FIGS. 3*a* and 3*b* show the upper and lower side of LED blocks 100, which respectively form one group of time marks. The latter are mounted with the striped metallized zones 101 on the corresponding connections, for example 31 to 35 and connected in a conducting manner with the latter. On the upper side of these blocks there are directly above the fully metallized zones 101 grid-like metallized zones 102, which form the cathode of the LED'S, at which the like effect forming the time mark is to be produced. The cathode is connected via the connection 103 with one of the connection points 51 to 62. The LED blocks 104 are suitably constructed for the representation of the light marks of the hours though in this case only four light marks per hour are provided. The blocks are mounted with the side shown in FIG. 4*b* on a corresponding number of connection 41 to 44 and have their cathode connected in accordance with FIG. 4*a* via the connection 105 with one of the points 71 to 82.

FIG. 5 shows the upper side of a timepiece dial constructed as a liquid crystal cell. In this case the electrodes for activation of the zones of the liquid crystal cell are reproduced by broken lines, in the case of which the electrodes are produced for example of tin oxide so as to be transparent. The structures shown as lines, which form the time marks for displaying the minutes, are denotes by reference numerals 131, 132 etc., in which case the count has been terminated with 138 in order to make the drawing clearer.

The time marks 131 . . . 136 are connected with contact surfaces 131' . . . 136', which are connected with the outputs of the integrated circuit in accordance with the inputs, reproduced in FIG. 2, 31' . . . 36'. The individual time marks 131 . . . 136 are, in a manner similar to the time marks 31 to 36, connected with the time marks 37, 38 . . . with the following time marks 137, 138 . . . .

The inner time marks 141 to 145 etc. serve for displaying the hours and are connected with corresponding contact surfaces 141' . . . 145' respectively in rows in tandem. The contact surfaces 141' . . . 145' are connected at the connection positions 41'. . . 45' for the integrated circuit (see FIG. 2). In FIG. 6 an insulating ring is represented, on which contact surfaces 131'' . . . 136'' and 141'' . . . 145'' are provided together with soldering support points 131''' . . . 136''', 141''' . . . 145''', which make it possible to produce the connection with the integrated circuit 31' . . . 36' and, respectively, 41' . . . 45'. Naturally in placing the ring in position in accordance with FIG. 6 on the arrangement in accordance with FIG. 5 the contact surfaces 131'' . . . 136'' come into contact with the contact surfaces 131' . . . 136' and the contact surfaces 141'' . . . 145'' come into contact with the contact surfaces 141' . . . 145'.

FIG. 7 shows a broken away view directed towards the lower side of the liquid crystal cell in the case of which the time marks are substantially opaque. In this respect five respective time marks 131$^{IV}$ . . . 135$^{IV}$ are connected with one contact surface 151, which contact surfaces are then connected with the connection 51' of the integrated circuit in accordance with FIG. 2. Following time marks which are not shown are led to corresponding following connections, which are only indicated diagrammatically and are connected with the following connections 52' . . . of the integrated circuit in accordance with FIG. 2.

Furthermore, a second group of time marks is provided for indicating the hours, which are denoted by the reference numerals 141$^{IV}$. . . 144$^{IV}$ and are connected with the connection 171, which is connected with the connection 171' for the integrated circuit in accordance with FIG. 2. In this case as well the four time marks 141$^{IV}$. . . 144$^{IV}$ are followed by further groups-of-four of time marks, which are connected with corresponding connections, which are only represented diagrammatically as a block and which are then connected for their part with the corresponding connection amongst the connections 71' . . . 82' for the integrated circuit in accordance with FIG. 2. FIG. 8 shows a further possibility in the case of which the time marks 131$^{IV}$ . . . 135$^{IV}$ etc. are combined to form electrode surfaces 130, which are again connected with the connecting surface 151. The same applies for the individual time marks 141$^{IV}$. . . 144$^{IV}$ in accordance with FIG. 7, which in the case of the embodiment in accordance with FIG. 8 are combined to form one electrode surface 140 with connection to the connection position 171.

FIG. 9 shows a ring for making contact at the lower side similar to the ring in accordance with FIG. 6.

FIG. 10 shows a ring of rubber which becomes conducting under pressure, which is placed between the lower or upper side of the liquid crystal cell and the rings of insulating material for making contacts in accordance with FIGS. 6 and 9 so that the contact between the liquid crystal cell and this rings is produced.

FIG. 11 shows a plan view of a timepiece dial diagrammatically indicating how the timepiece in the case of the use of an LED display with a timepiece dial constructed in a decorative manner indicates the time on the actuation of a switch. The timepiece dial is denoted by reference numeral 110 and carries over its periphery marks 111, which if required can be amplified by luminous markings 112. One marking 113 indicates the center of the timepiece dial. At this position on actuating the switch the second pulses can be caused to appear. Reference numeral 114 indicates the minutes display while reference 115 indicates the hours display.

FIGS. 1 and 2 are to be caused to correspond as follows.

The outputs $A_1 \ldots A_6$ of the decoder 5 are connected with the connections 31' . . . 36'.

The outputs A'1 . . . A'5 of the decoder 15 are connected with the connections 41' . . . 45'. The outputs $K_1 \ldots K_{12}$ of the decoder 7 are placed against or connected with the connections 51' . . . 62' in accordance with FIG. 2. Then the outputs K'1 . . . K'12 of the decoder 17 lie correspondingly against the connection positions 71' . . . 82' of the circuit in accordance with FIG. 2.

I claim:

1. An electronic timepiece with a display device, employing an oscillator as a time base, a frequency divider for dividing the frequency of the oscillator to the desired clock frequency, counting means for counting the clock pulses and decoding circuits, which apply the clock pulses to the display device such that time marks are switched on for displaying the time, the improvement comprising:

said counting means including a forward-backward counter having an input coupled to said frequency divider and an output coupled to the input of a simple counter, which on a complete operational cycle runs through the number of time marks completely; and wherein a first decoding circuit is coupled to the simple counter and to first electrodes of one respective group of time marks of the display;

a second decoding circuit coupled to the forward-backward counter and to other electrodes of other time marks of the display, and means coupling remaining time marks of the display to said one and other time marks such that the time marks following the time marks connected with the last output of said second decoding circuit are respectively coupled with the outputs of said first decoding circuit in a reversed sequence such that sequential actuation of all time marks is completed.

2. An electronic timepiece as defined in claim 1, wherein said clock frequency corresponds to minute periods and said timepiece further includes a second group of time marks and further including a second forward-backward counter, and a second simple counter coupled to said second forward-backward counter by means of a divider circuit and a decoding means coupled to said second forward-backward counter and second simple counter for driving said second group of time marks along the same lines as said first group of time marks.

3. An electronic timepiece as defined in claim 1, wherein said second decoding circuit includes a plurality of outputs and further including a NAND-gate coupling a first and last output of said forward-backward counter to said simple counter.

4. An electronic timepiece in accordance with claim 1, and further including a second divider coupled between said frequency divider and said simple counter for providing output pulses corresponding to a time period greater than that associated with said time marks.

5. An electronic timepiece as defined in claim 1, wherein said display comprises an insulating carrier and said time marks comprise electrodes on said carrier.

6. An electronic timepiece as defined in claim 5, wherein said oscillator, the divider stages, the counters, and the decoding means comprise integrated circuits and wherein all conducting paths which connect the connections of the time mark electrodes with the connections of said integrated circuits comprises conductors printed on said carrier.

7. An electronic timepiece as defined in claim 6, wherein said time marks further comprise LED'S.

8. An electronic timepiece as defined in claim 7, and including a block, extending over a number, reduced by the digit "1" of the outputs of the decoding circuit of the forward-backward counter, wherein said display comprises LED material metallized in sections on the surface mounted on the insulating carrier and soldered to the connections, and on the side remote from this has at those positions, at which the time marks appear, a respective grid-like metallization, said metallizations being connected with each other and with the corresponding output of the decoding circuit of the simple counter.

9. An electronic timepiece as defined in claim 8, wherein said grid-shaped metallizations of the time marks and the associated metallizations on the other side of the block are directed towards the center in a circular arrangement.

10. An electronic timepiece as defined in claim 9, wherein an insulating layer is placed over said associated metallizations, on which the conductor tracks are provided, said insulating layer including windows for producing a conducting connection between the blocks and the corresponding connections of the integrated circuit.

11. An electronic timepiece as defined in claim 10 wherein, said insulating layer is covered with a covering sheet, consisting of opaque material and constructed to resemble a timepiece face and which includes portions adjacent to the time marks which are at least transluscent.

12. An electronic timepiece as defined in claim 1 wherein said display comprises a liquid crystal cell employed as a dial for the timepiece, said cell including one surface carries transparent electrodes, corresponding to the arrangement of the time marks said electrodes being so connected that the following time marks are so connected with the preceding time marks that the time marks following the time mark connected with the last output of said second decoding circuit are respectively connected with the other outputs of said first decoding circuit in a reversed sequence and this coupling of the time marks is continued for the whole of the timepiece dial while its surface remote from a viewer is covered at the positions of the time marks with substantially non-transparent electrodes.

13. An electronic timepiece as defined in claim 12, wherein the electrodes for excitation of said liquid crystal cell comprises rings of rubber which becomes conductive under pressure.

14. For use in an electrical timepiece having time marks selectively actuated each by a signal applied to an associated pair of electrodes to provide a sequential time representative display, an improved electrical circuit for actuating said electrodes comprising:

a time base oscillator;

frequency dividing means coupled to said oscillator;

reversible counter means coupled to said frequency dividing means;

first decoder circuit means coupled to said reversible counter means and to a first set of electrodes for sequentially applying signals to said first set of electrodes representative of a predetermined increment of time;

additional counter means and means coupling said additional counter means to said first decoder circuit means to receive an actuating signal at the end of the forward or reverse count of said reversible counter means; and second decoder circuit means coupled to a second set of electrodes associated with said first set of electrodes for sequentially actuating time marks associated with said first and second set of electrodes for sequentially displaying predetermined time intervals.

* * * * *